US006261416B1

(12) United States Patent
Esslinger et al.

(10) Patent No.: US 6,261,416 B1
(45) Date of Patent: Jul. 17, 2001

(54) DEVICE AND METHOD FOR DRAINING A WEB

(75) Inventors: Klaus Esslinger, Nattheim; Gerhard Kotitschke, Steinheim; Wolfgang Mayer, Heidenheim; Andreas Meschenmoser, Horgenzell, all of (DE); Günther Mohrhardt, Sao Paolo (BR)

(73) Assignee: Voith Sulzer Papiermaschinen GmbH, Heidelheim (DE)

( * ) Notice: Subject to any disclaimer, the term of this patent is extended or adjusted under 35 U.S.C. 154(b) by 0 days.

(21) Appl. No.: 08/995,517

(22) Filed: Dec. 22, 1997

(30) Foreign Application Priority Data

Dec. 23, 1996 (DE) ..... 196 54 195
Feb. 10, 1997 (DE) ..... 197 05 030

(51) Int. Cl.[7] ..... D21F 2/00; D21F 3/04

(52) U.S. Cl. ..... 162/205; 162/210; 162/306; 162/358.1; 162/349; 162/358.3; 162/358.4; 162/360.2

(58) Field of Search ..... 162/358.1, 358.2, 162/358.3, 358.4, 205, 360.2, 210, 207, 306, 349

(56) References Cited

U.S. PATENT DOCUMENTS 4,948,466 8/1990 Jaakkola .
5,389,205 * 2/1995 Pajula et al. ..... 162/205
5,522,959 6/1996 Ilmarinen .
5,639,351 6/1997 Ilmarinen .
5,681,431 10/1997 Steiner .

FOREIGN PATENT DOCUMENTS 4340041 4/1994 (DE) .
4301750A1 7/1994 (DE) .
4301750C2 7/1994 (DE) .
337973 10/1989 (EP) .
549553 6/1993 (EP) .

OTHER PUBLICATIONS

Copy of a German Search Report dated Jul. 29, 1997.

* cited by examiner

*Primary Examiner*—Peter Chin
(74) *Attorney, Agent, or Firm*—Greenblum & Bernstein, P.L.C.

(57) ABSTRACT

Device and method for draining a web in a paper production machine. The device may include a press section having at least one press nip for draining and smoothing the web. The at least one press nip may be arranged to smooth one surface of the web more than its opposite surface and the device may also include a roughening device that roughens the one surface of the web. The method may include guiding the web through a press section of the paper production machine to drain and smooth the web in which the press section include at least one nip, smoothing one surface of the web more than its opposite surface in the at least one nip, and roughening the one surface.

27 Claims, 5 Drawing Sheets

DEVICE AND METHOD FOR DRAINING A WEB

CROSS-REFERENCE OF RELATED APPLICATIONS

The present application claims priority under 35 U.S.C. §119 of German Patent Application No. 196 54 195.6, filed Dec. 23, 1996, and of German Patent Application No. 197 05 030.1, filed Feb. 10, 1999.

BACKGROUND OF THE INVENTION

1. Field of the Invention

The present invention relates to a device for draining a web, e.g., a paper web, in a paper production machine having a press section with at least one press nip (opening) through which the web is guided and thereby drained and smoothed. However, in accordance with an exemplary embodiment of the present invention, one side of the web is more strongly smoothed than the other side.

Further, the present invention relates to a method for draining a web, e.g., a paper web, in a paper production machine, in which the web is guided through at least one press nip (opening) in which the web is drained and thereby smoothed. However, in accordance with this exemplary embodiment, one side of the web in the press nip is more strongly smoothed than the other side.

2. Discussion of the Background Information

The drainage of a paper web in a press section normally takes place with the aid of felt belts which are guided through the press openings together with the paper web. The water which is pressed out of the paper web is absorbed and removed by the felt sheets. Because the felt sheets are usually guided in loops, these felt sheets must be conditioned to maintain their water-absorbing capabilities.

With devices in use today for draining paper webs, usually one side of the web is more frequently pressed in contact with the felt than the other. Out of concern for a well-supported sheet guidance and an undesirable remoistening of the paper web, the web is guided together with only one felt belt through at least the last press opening. For example, in a known press section having three press nips, the upper web side is pressed in contact with the felt three times, while the lower web side is pressed in contact with the felt in the first press nip and against an outer surface of a smooth roll in the other two openings. As a result, a significant difference in roughness values between the upper and lower sides of the raw paper occurs after the press nip. Such a difference in the roughness leads, in particular, to differing printing characteristics for the paper and, thus, is often not desired.

It is already known how to balance differing roughness values between the two sides of a paper web that is caused by differing smoothing in the web draining device, e.g., by performing a unilateral smoothing of the paper web on a side opposite to a previous unilateral smoothing, i.e., after the press section in the end treatment of the paper. It is also known how to avoid a unilateral, greater smoothing of the paper web by arranging a same number of rolls for smoothing both sides of the paper web. Such an even arrangement of smoothing rolls is, however, not always possible or desirable. In addition, the unilateral smoothing in the opposite direction during the end treatment of the paper web is relatively costly.

SUMMARY OF THE INVENTION

Thus, the present invention provides device similar in general to the type mentioned above that enables, in a relatively simple manner, draining the paper web while ensuring an essentially equal degree of roughness on both sides of the web.

Further, the present invention presents a method similar in general to the type mentioned above that enables draining the web and ensuring an essentially equal degree of roughness on both sides of the web after the draining.

The device of the present invention may include a device for roughening a side of the web that was more smoothed in the press section.

The method of the present invention may include roughening the web on its smoother side.

Unlike the previously known devices for draining a web, an additional smoothing of an upper side of the web, which was less smoothed in the press section, does not take place according to the invention. Rather, the more-smoothed side of the web is roughened such that, upon leaving the press section, a substantially even-sided roughness of both sides of the web results. This result is favorable not only from a structural standpoint for the device, but also provides the advantage that, if desired, an over-smoothing of both sides of the web can be prevented. The device in accordance with the present invention can be used, e.g., when it is not possible or desirable to arrange a same number of smoothing rolls on both sides of the web. In addition, the device in accordance with the present invention can be used advantageously when it is not possible or desirable to smooth the web in the opposite direction in the post-treatment phase.

In a preferred exemplary embodiment of the present invention, a pre-press device may be positioned before the press section for roughening the web. The pre-press device may be designed to produce a higher degree of roughness on the more-smoothed side of the web than the other side. In particular, the roughness difference may be selected such that the web exhibits an essentially equal degree of roughness on both sides after leaving the press section. A pre-positioned pre-press device, which may be formed or created, e.g., by two rolls forming a press nip between them and a roughness compensation for partially draining the web even before entering the press section. Because of the higher dry content of the web achieved upon entry to the press nip, drainage in the press section is improved.

According to a further embodiment of the present invention, the pre-positioned pre-press device may include a screen belt guided through the press nip together with the web such that the screen belt is positioned on the side of the web to be roughened. The screen belt, preferably guided in a loop, causes a roughening of the side of the web lying against it as the web is guided through the pre-press device. Thus, in a preferred embodiment, the paper-production screen may be utilized as the pre-positioned screen loop because it is already positioned before the press section for the purpose of draining the web. A press device is additionally arranged in this screen loop such that the web is guided through the press nip with the screen belt.

According to the present invention, it may be particularly advantageous to position the press device behind (with respect to a circumferential direction of the screen loop) a screen suction roll present in the screen loop.

According to a further embodiment of the present invention, the pre-press device may include at least one felt belt guided through the press nip with the web. Water pressed out in the pre-press device may be advantageously removed by the felt belt. By positioning a felt belt inside of the screen loop, i.e., on a side of the screen belt opposite the web, the screen belt may be supported on its running side and water pressed out of the web may transported out of the press zone.

The felt belts are also preferably guided in loops. Conditioning devices can be utilized to advantageously maintain the water absorption capability of the felt belts.

Instead of a felt belt guided through the press nip of the pre-press device, the pre-press device can also include a roll with a felt covering. Water pressed out can thereby be removed. It is further preferred that a conditioning device be provided, e.g., a felt-washing press device for the felt covering, to maintain the water absorption capability of the felt cover.

By utilizing a suction contact roll in the pre-press device, the web may be advantageously separated from the screen belt and guided in a suitable manner to a subsequently-arranged press section.

According to further embodiments of the present invention, the pre-press device may include a roll with recesses, e.g., grooves or blind holes, formed in the roll sleeve surface. In this manner, the water absorption of the roll may be increased, thus, improving the drainage capability of the pre-press device. The pre-press device can also include a roll with a suctioned roll sleeve surface to increase the drainage capacity.

The press section for draining the web can, according to embodiments of the present invention, include, e.g., one, two or three press nips formed or created by main press devices. The main press devices are designed, e.g., as shoe presses, and in particular as extended or elongated nip presses. All of the main press devices also include at least one felt belt guided with the web through the respective press nip. The felt belts may be provided as loops and may be provided with conditioning devices to improve the water absorption capabilities of the felt belts.

In a press section having only one main press device, only one felt belt may be guided through the press nip. The one felt belt may be positioned to contact the upper side of the web.

In a press section having two main press devices, the main press device may include two stiff rolls while the second main press device may be formed as a shoe press, e.g., an extended nip press. The first main press device with two stiff rolls may located before the shoe press, with regard to a web run direction. This particular embodiment of the main press device and the specific arrangement is particularly advantageous.

In accordance with a further embodiment of the present invention, one of the stiff rolls of the first main press device may be formed as a roll which is, at the same time, part of the pre-positioned pre-press device. In this manner, rolls can be saved and the cost of the device correspondingly lowered.

According to a further embodiment of the present invention, both main press devices can be designed as shoe presses, e.g., extended nip presses. This particular embodiment and arrangement of the main press devices has also proven advantageous.

In a press section with three main press devices, two main press devices are formed as shoe presses, e.g., extended nip presses, while the third main press device is formed of two stiff rolls. It is preferred that, in the web run direction, the first and the third main press device are formed with the shoe presses and the second main press device is formed with the two stiff rolls. It is particularly advantageous if the two stiff rolls of the second main press device are formed by the stiff rolls of the two shoe presses. In this manner, two rolls may be saved and the cost of the press section may be lowered.

According to a further embodiment of the present invention, two felt belts may be provided in, and guided through, the press nip of first main press device with the web. However, in each of the other press devices only one felt belt and the web is guided the respective press nips. In this manner, good results are achieved with regard to draining and smoothing.

The line pressure on the web on the pre-press device may be, e.g., between approximately 20 and 100 kN/m, and in particular approximately 50 kN/m. These values have been shown to be particularly suitable.

Accordingly, the present invention is directed to a device for draining a web. The device may include a press section having at least one press nip for draining and smoothing the web. The at least one press nip may be arranged to smooth one surface of the web more than its opposite surface and the device may also include a roughening device that roughens the one surface of the web.

According to another feature of the present invention, the device may include a pre-press section positioned before the press section with respect to a web travel direction. The pre-press section may include the roughening device to provide a greater degree of roughness to the one surface than its opposite surface. Further, the pre-press device may include two rolls positioned to form a press nip.

According to another feature of the present invention, the pre-press device may include a screen belt positioned adjacent the one surface of the web to be roughened and guided with the web through the press nip. Further, the screen belt may be composed of a paper-production screen guided to form a screen loop, the screen loop being positioned before the press section. Still further, the pre-press device may include a screen suction roll located within the screen loop and before the pre-press device, with respect to a circulation direction of the screen loop.

According to still another feature of the present invention, the pre-press device may include at least one felt belt guided with the web through the press nip. Further, the at least one felt belt may be positioned adjacent the opposite surface. Alternatively, the at least one felt belt may be guided through the press nip adjacent the opposite surface. Further, the device may include at least one conditioning device to condition the at least one felt belt.

According to a further feature of the present invention, the pre-press device may include a roll having a felt cover. Further, the device may include a conditioning device to condition the felt cover, and a felt-washing press device to condition the felt cover.

According to still another feature of the present invention, the pre-press device may include a suction contact roll.

According to a still further feature of the present invention, the pre-press device may include a roll having a roll sleeve surface with recesses. The recesses may include grooves in the roll sleeve surface or the recesses may include blind holes in the roll sleeve surface.

According to another feature of the present invention, the pre-press device may include a roll having a suctioned roll sleeve surface.

According to another feature of the present invention, the press section may be arranged such that the one surface of the web is treated more than its opposite side.

According to still another feature of the present invention, the press section may be positioned after the roughening device in the web travel direction and the press section may include only one main press device. Further, the main press device may further include a felt belt guided through a main press nip with the web. Still further, the felt belt may contact the one surface of the web.

According to a further feature of the present invention, the main press device may further include an extended nip shoe press.

According to a still further feature of the present invention, the main press device may further include a roll arranged within a felt belt loop with a roll of the pre-press device.

According to another feature of the present invention, the press section may be positioned after the roughening device in the web travel direction and the press section may include two main press devices. Further, at least one of the two main press devices may form a main press nip, the at least one main press device may include only one felt belt guided with the web through the main press nip.

According to still another feature of the present invention, the two main press devices may include a first main press device composed of two stiff rolls. Further, the two main press devices further include a second main press device composed of a shoe press having an extended nip press. Still further, the first main press device is positioned before the second main press device, with respect to the web travel direction. Even further, one of the two stiff rolls is provided by a roll of the pre-press device.

According to a further feature of the present invention, the two main press devices may be composed of shoe presses. Further, the shoe presses may include extended nip presses.

According to another feature of the present invention, the press section is positioned after the roughening device in the web travel direction and the press section may include three main press devices. Further, at least one main press device may form a main press nip, the at least one main press device including only one felt belt guided with the web through the main press nip. Still further, the at least one main press device includes two felt belts positioned on both surfaces of the web guided with it through the main press nip. Alternatively, the three main press devices include two main press devices composed of shoe presses including extended nip presses. Further, the three main press devices include a first press device and a third main press device composed of shoe presses, each shoe press including a stiff roll, and the three main press devices further include a second press device formed by the stiff rolls the shoe presses. The first, second, and third press devices are arranged in this order in the web travel direction.

According to a still further feature of the present invention, the pre-press device is composed of an extended nip shoe press.

According to still another feature of the present invention, the web may include a paper web in a paper production machine.

The present invention is also directed to a method for draining a web in a paper production machine. The method may include guiding the web through a press section of the paper production machine to drain and smooth the web in which the press section include at least one nip, smoothing one surface of the web more than its opposite surface in the at least one nip, and roughening the one surface.

According to another feature of the present invention, the roughening of the web occurs before the smoothing of the one surface of the web more than its opposite surface. Further, the roughening of the one surface of the web includes guiding the web over a pre-press device prior to guiding the web through the press section, and roughening the one surface in the pre-press device. Still further, the roughening of the one surface includes positioning a screen belt adjacent the one surface and guiding the screen belt and the web through the pre-press device.

According to a further feature of the present invention, the method may include draining the web in the pre-press device with at least one of at least one felt belt guided with the web and a press roll having a felt cover. Further, the method may include conditioning the at least one of the felt belt and the felt cover and conditioning the felt cover in a washing press.

According to still another feature of the present invention, the method may include suctioning at least one roll of the pre-press device.

According to a further feature of the present invention, the method may include draining the web via at least one felt in press nips of at least one main press device.

According to yet another feature of the present invention, the method may include more strongly smoothing the one surface of the web in the press nips.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
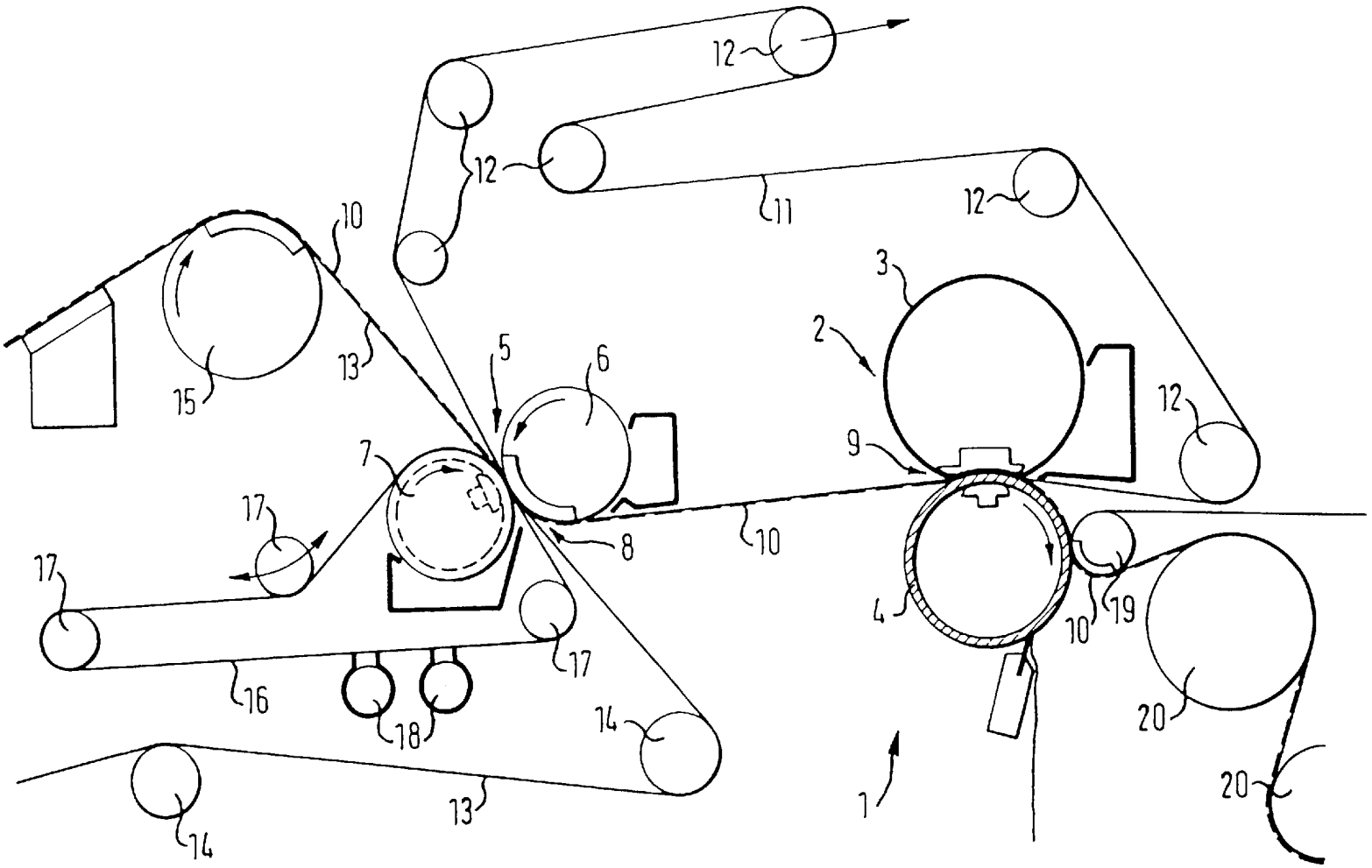
FIG. 1 illustrates a device in accordance with the present invention having a press section with a press nip.

In a most simply illustrated embodiment of the present invention in accordance with FIG. 1, a press section 1 for draining a web 10, e.g., a paper web, may include a single main press device 2 formed by a shoe press having a first roll 3 with a flexible roll sleeve and a second roll 4 which is a stiff mating roll. Positioned ahead of or before the press section 1, i.e., in a web travel direction, is a pre-press device 5 that may include a first roll 6, which may be a suction contact roll, and a second roll 7, which may have a surface provided with recesses, e.g., grooves or blind holes, to increase the water-absorbing capability of the roll sleeve. Pre-press device 5 may form a first press nip (opening) 8 and main press device 2 may form a second press nip 9. Web 10 may be guided through each of the first and second press nips 8 and 9, respectively.

First roll 3 of main press device 2 and first roll 6 of pre-press device 5 may be positioned together within in a loop formed or created by a felt belt 11 guided over a plurality of deflection rolls 12. Second roll 7 of pre-press device 5 may be arranged inside a loop formed or created by a paper-production screen 13 guided over a plurality of deflection rolls 14 and over a screen suction roll 15. Second roll 7 of pre-press device 5 may also be positioned within a loop formed or created by a second felt belt 16 guided over deflection rolls 17. To maintain the water-absorbing capability of felt belt 16, conditioning devices 18 may be provided. Corresponding conditioning devices may also be provided for felt belt 11. At least one of each of the plurality of deflection rolls 12, 14 and 17 is flexible to create a belt tension.

Felt belt 11, paper-production screen 13 and felt belt 16 may be guided through first press nip 8 with web 10. In this manner, felt belts 11 and 16 may be positioned adjacent to rolls 6 and 7, respectively, and paper-production screen 13 may be positioned to run between web 10 and felt belt 16. Only felt belt 11 may be guided through second press nip 9 with web 10. In this manner, felt belt 10 may run adjacent to first roll 3. Accordingly, in first press nip 8, an upper side of web 10 may be in contact with felt 11 and a lower side may be in contact with screen 13, while in second press nip 9, only the upper side of web 10 is in contact with felt belt 11. The paper-production screen 13 may be supported by felt belt 16 in first press nip 8.

Paper web 10 guided over paper-production screen 13 and screen suction roll 15 may run through first press nip 8 and may be drained. In this manner, the water pressed out may be removed on one side by felt belt 11 and on the other side by felt belt 16. At the same time, the lower side of paper web 10 may be roughened in first press nip 8 by the non-uniform (non-smooth) surface of paper-production screen 13. Subsequently, paper web 10 may be guided through second press nip 9. To ensure proper loosening of paper web 10 from paper-production screen 13 after first press nip 8, first press roll 6 of the pre-press device 5 may be formed by a suction contact roll.

In second press nip 9, web 10 may be further drained. In this manner, the water pressed out may be transported out of press zone by felt belt 11. At the same time, the lower side of paper web 10, which was roughened in the pre-press device 5, may be smoothed by the smooth sleeve surface of stiff roll 4 of main press device 2. In this manner, the upper and lower sides of web 10 may exhibit substantially a same degree of roughness after leaving main press device 2. Paper web 10 may be subsequently guided over a suction contact roll 19 and a further roll 20 to a paper end treatment. The main drainage capacity may be provided by main press device 2. Accordingly, forming main press device 2 as a shoe press enables selective control of drainage and smoothing.

Figure 2:
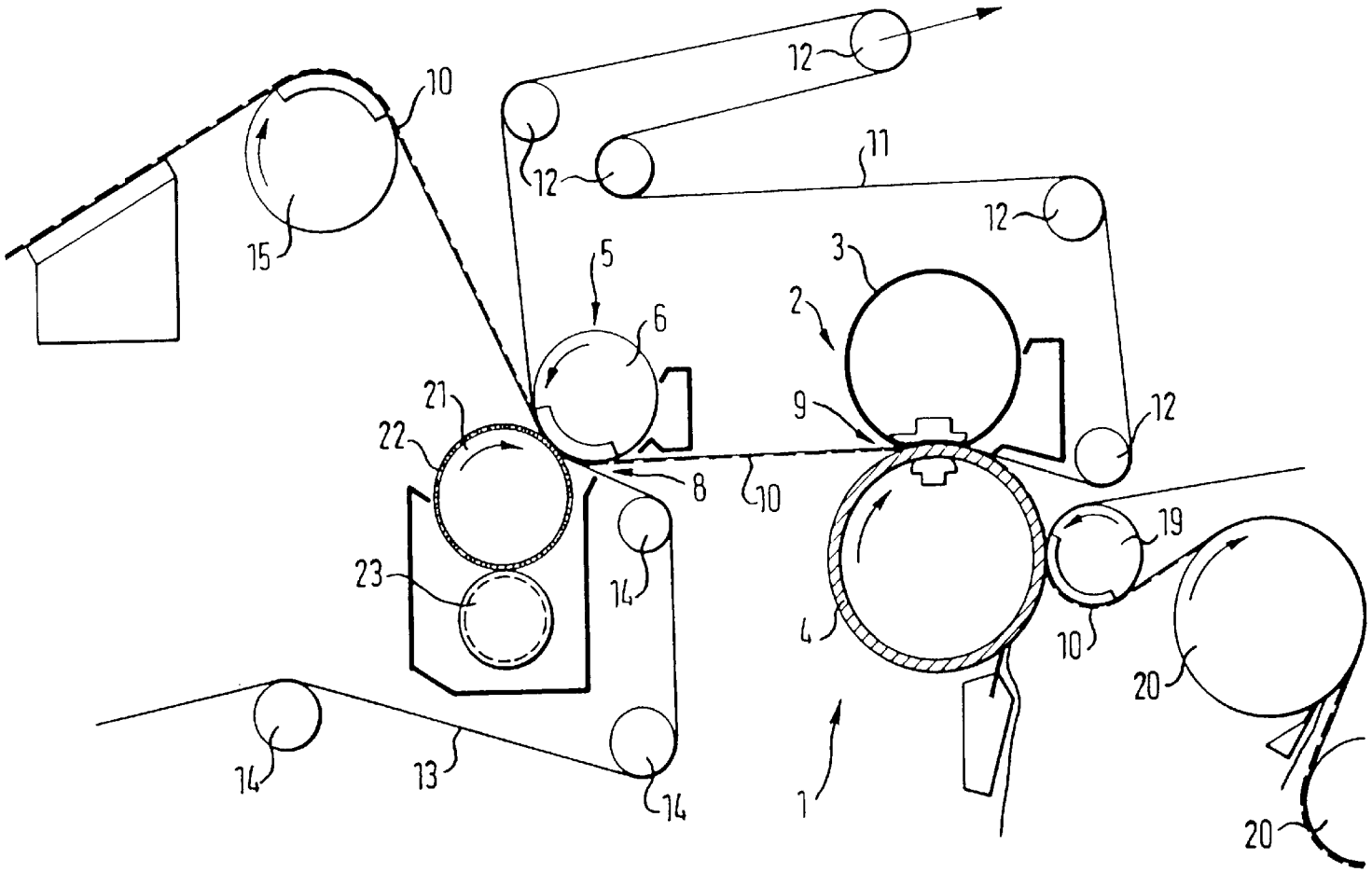
FIG. 2 illustrates a variation of the device depicted in FIG. 1.

A variation of the device of FIG. 1 is illustrated in FIG. 2. This alternative embodiment differs from that depicted in FIG. 1 only in regard to the pre-press device 5. Pre-press device 5 may include first roll 6 formed by a suction contact roll and a second roll 21 with a felt cover 22. Felt belt 16 with deflection rolls 17 depicted in FIG. 1 is omitted in this alternative. A washing press 23 may be provided for conditioning felt cover 22. However, the method of operation for this device otherwise corresponds with that of FIG. 1.

Figure 3:
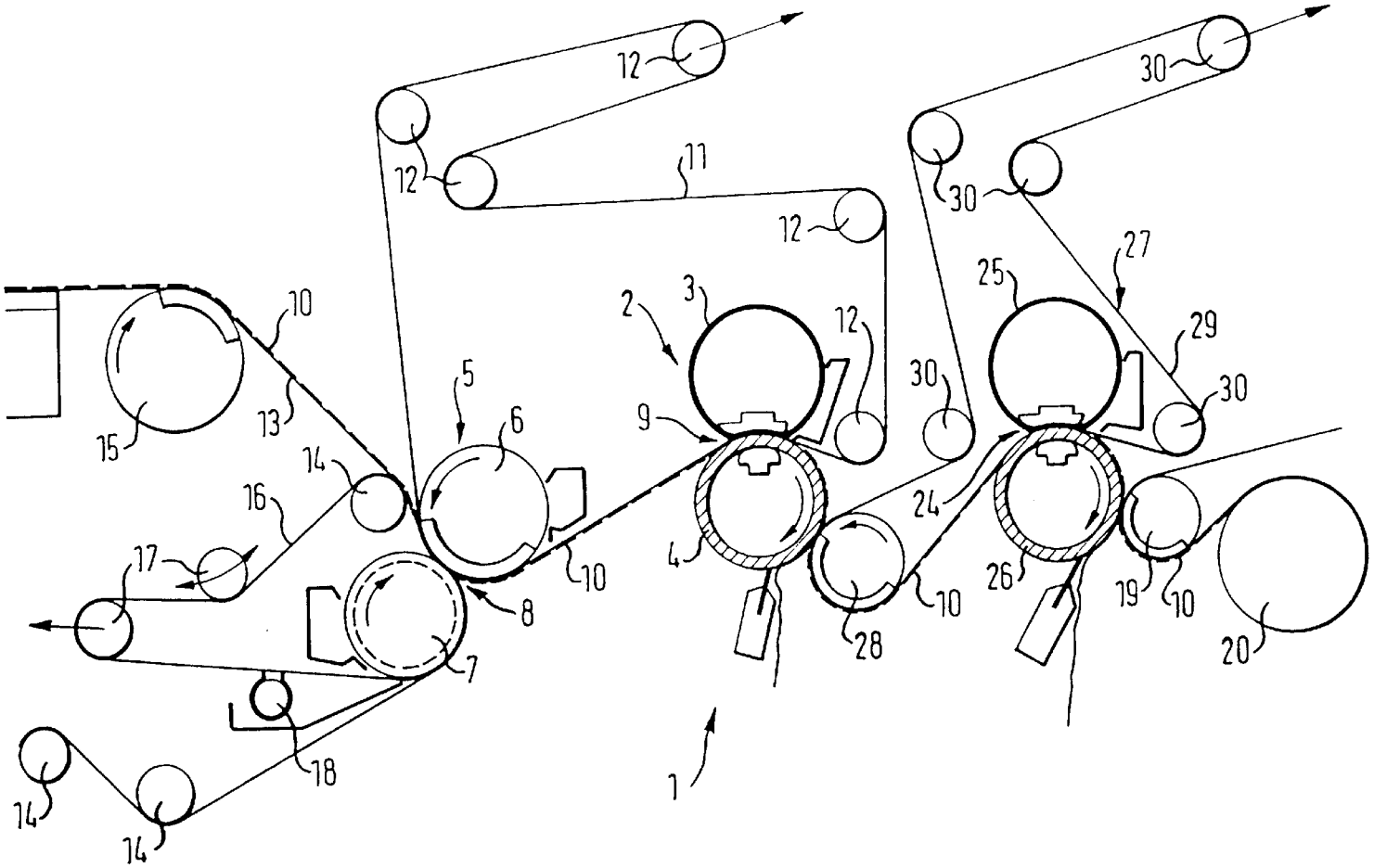
FIG. 3 illustrates a device in accordance with the present invention having a press section with two press nips.

In the embodiment illustrated in FIG. 3, pre-press device 5 corresponds to the pre-press device illustrated in FIG. 1. First press nip 8 may be formed or created by first roll 6, formed by a suction contact roll, cooperating with second roll 7, provided with recesses in the roll sleeve. Paper-production screen 13, which is positioned to roughen the lower side of web 10, may be guided through press nip 8 with web 10. First roll 6 and second roll 7 may be arranged within the loop of a felt belt 11 and 16, respectively. Further, felt belts 11 and 16 may be positioned to run adjacent to rolls 6 and 7, respectively. Here, too, felt belt 16 may support paper-production screen 13 and, together with felt belt 11, may remove pressed-out water from the press area.

In this alternative device, following first press nip 8, continuous web 10 may be guided to a second press nip 9 formed between first roll 3 and second roll 4 of a main press device 2 formed as a shoe press. Unlike the device illustrated in FIG. 1, paper web 10 may, however, be guided from second press nip 9 to a third press nip 24, formed or created between a first roll 25 and a second roll 26 of a second main press device 27. Paper web 10 may be removed from second roll 4 of first main press device 2 by a suction contact roll 28, which may be located with first roll 25 of second main press device 27 within a loop formed or created by a felt belt 29 guided over a plurality of deflection rolls 30. At least one of deflection rolls 30 is flexible to hold felt belt 29 under tension. Following third press nip 24, the continuous web 10 reaches an end treatment station, e.g., via a suction contact roll 19 and a further roll 20.

Second main press device 27, like the first main press device 2, may be formed by a shoe press to enable selective drainage and smoothing of paper web 10. The water pressed out may be removed from press nips 9 and 24 by felt belts 11 and 29, respectively. Felt belts 11 and 29 may also be treated by conditioning devices to maintain their water-absorbing capabilities. Both main press devices 2 and 27 may be formed as upper felt presses, i.e., the upper side of paper web 10 is in contact with the felt in both press nips 9 and 24 while the lower side of paper web 10 lies against the smooth surface of mating roll 4 and 26. In both press devices 2 and 27, the lower side of paper web 10 is more strongly smoothed than the upper side. The lower side of paper web 10 is correspondingly roughened by paper-production screen 13 in pre-press device 5 to ensure an essentially equal degree of roughness on both sides of web 10 upon exiting press section 1.

Figure 4:
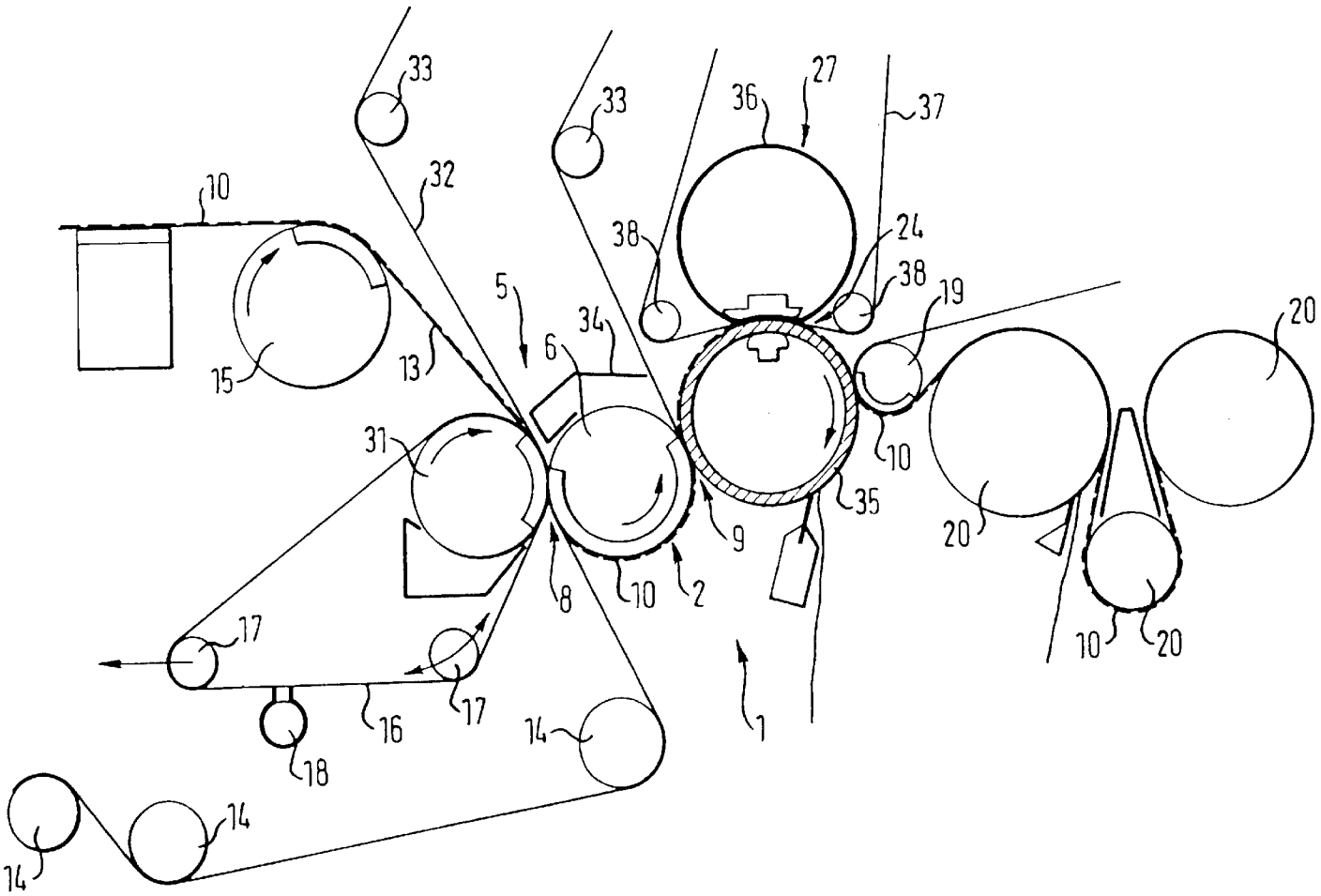
FIG. 4 illustrates a variation of the device depicted in FIG. 3.

In the device in accordance with the present invention illustrated in FIG. 4, in addition to first press nip 8 and second press nip 9, a third press nip 24 may be formed such that first press nip 8 is provided in a pre-press device 5 and second and third press nips 9 and 24 are provided in first and second main press devices 2 and 27.

Pre-press device 5 may include a first roll 6 and a second roll 31 formed of suction contact rolls. The second suction contact roll 31 may be positioned within a loop formed or created by felt belt 16 and paper-production screen 13. In this manner, felt belt 16 may be positioned adjacent second roll 31. First roll 6 of pre-press device 5 may be positioned within the loop of a felt belt 32 which is guided over a plurality of deflection rolls 33, at least one of which is flexible for creating a belt tension. Finally, pre-press device 5 may be equipped with a suction device 34 to vacuum the upper side of second roll 31 to remove pressed-out water.

Second press nip 9 of first main press device 2 may be formed or created between first roll 6 of pre-press device 5 and a further roll 35. Roll 35 may also be provided as a mating roll for second main press device 27, which may be formed by a shoe press. Thus, roll 35 may create a third press nip 24 with a further roll 36 having a flexible roll sleeve. Roll 36 may be positioned within a loop formed or created by a felt belt 37 guided by a plurality of deflection rolls 38, at least one of which is flexible. Here, too, following second main press device 27, suction contact roll 19 and a further roll 20 may be provided for guiding the paper web.

In the device in accordance with FIG. 4, paper web 10 may be guided through first press nip 8 between paper-production screen 13 and felt belt 32. From there, paper web 10 reaches suction contact roll 6 and second press nip 9 created by roll 6 and mating roll 35 of second main press device 27. Web 10 is guided on a surface of mating roll 35 to a third press nip 24 formed by shoe press device 27 between rolls 35 and 36. After the lower side of paper web 10 is roughened in pre-press device 5, the lower side of paper web 10 is smoothed in second press nip 9 and third press nip 24 by the smooth surface of stiff mating roll 35. In this manner, paper web 10 leaving press section 1 exhibits upper and lower sides having substantially the same degree of roughness. The removal of the pressed-out water and the conditioning of felt belts 16, 32 and 37 take place in the same way as described in the previous embodiments.

Figure 5:
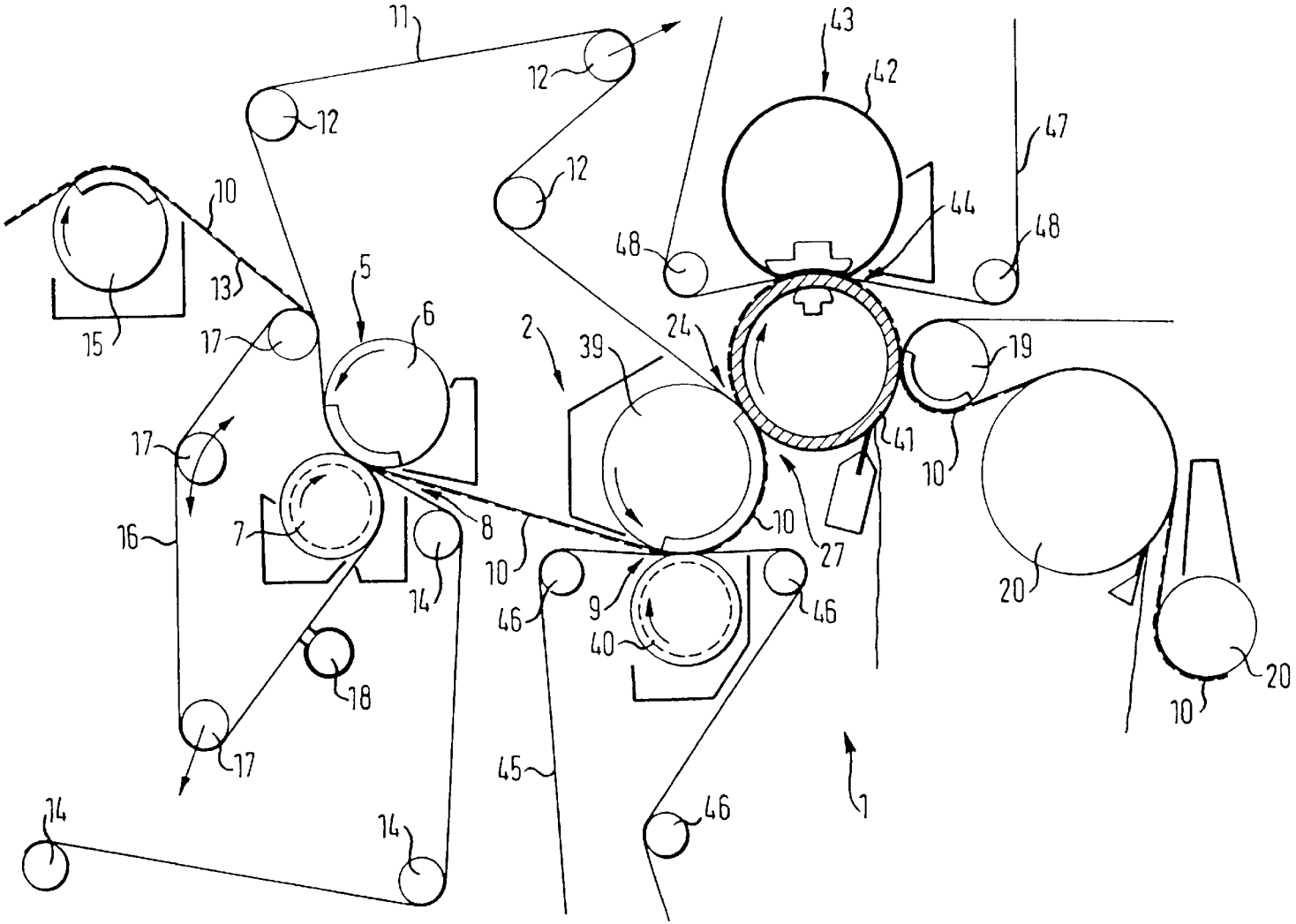
FIG. 5 illustrates a device in accordance with the present invention having a press section with three press nips.

Pre-press device 5 in accordance with the exemplary embodiment shown in FIG. 5 substantially corresponds with that depicted in FIG. 1. In this embodiment, first press nip 8 may be formed or created between first roll 6 formed by a suction contact roll and second roll 7 having a surface that includes recesses. Rolls 6 and 7 may each be arranged in a loop of a felt belt 11 and 16, respectively. Second roll 7 may be positioned within a loop formed by paper-production screen 13 running through first press nip 8 between paper web 10 and felt belt 16.

After first press nip 8, paper web 10 may be guided through a second press nip 9 formed or created between first roll 39 formed by a suction contact roll and second roll 40 of first main press device 2. Thus, suction contact roll 39 may form or create a mating roll for roll 40, which may include a flexible roll sleeve, formed by a shoe press roll. From second press nip 9, paper web 10 may reach third press nip 24 formed or created in main press device 27 between suction contact roll 39 and a stiff roll 41. Stiff roll 41 may also be utilized as a mating roll for shoe press roll 42 of third main press device 43. In this manner, a fourth press nip 44 may be formed or created through which continuous web 10 may be guided following third press nip 24. Here, too, paper web 10 may be removed from stiff roll 41 by a suction contact roll 19 and guided via a further roll 20 to further treatment.

Suction contact roll 39 of first main press device 2 and suction contact roll 6 of the pre-press device 5 may be positioned within a loop formed or created by felt belt 11. Second roll 40 of first main press device 2 may be positioned within its own loop of a further felt belt 45 that is guided over a plurality of deflection rolls 46, at least one of which is flexibly formed to create a belt tension. Finally, shoe press roll 42 of third main press device 43 may be positioned within a loop of a felt belt 47 guided over a plurality of deflection rolls 48, one of which is flexibly designed. In all three main press devices 2, 27 and 43, the upper side of paper web 10 may be in contact with the felt. However, only in first main press device 2 is the lower side of paper web 10 also in contact with the felt. In second main press device 27 and third main press device 43, the lower side of paper web 10 is smoothed by the smooth surface of stiff roll 41. This predominant smoothing of the lower side of paper web 10 may be, however, substantially compensated for by the roughening of the lower side of paper web 10 in pre-press device 5, i.e., caused by paper-production screen in press nip 8. The manner of operation of this exemplary embodiment corresponds with that of the devices previously described, in particular with respect to the removal of the pressed-out water and the conditioning of the felt belts 11, 16, 45 and 47.

In addition, each of the above-described devices have in common that paper web 10 may be treated or created in a relatively simple manner such that the upper and lower sides of the web exhibit a substantially equal degree of roughness. This characteristic may be achieved in each case because the lower side of paper web 10 is roughened in pre-press device 5, so that the subsequent smoothing of the lower side is compensated for.

It may be advantageous if paper-production screen 13, which is necessary to the paper production process, is also used for roughening the lower side of paper web 10, i.e., by being guided through first press nip 8 of pre-press device 5. Fundamentally, however, other manners of roughening the lower side of paper web 10 are conceivable in order to compensate for the predominant smoothing of one side of paper web 10. In particular, it is not necessary that the roughening occur in the press device. However, pre-press device 5 may have the advantage that continuous web 10 is already pre-drained before entering press section 1. In this manner, paper web 10 may exhibits a low water content upon entry to press section 1.

The rolls of pre-press device 5 and main press devices 2, 27, and/or 43 can be arranged in combinations other than those shown provided so that at least one part of these rolls form or create more than one press nip. In this manner, the total number of rolls may be kept to a minimum. Likewise, the felt belts can also be guided around more than one roll in other ways than described in order to keep their number to a minimum.

Particularly preferred is an embodiment in which a pre-press device 5 may include two rolls, i.e., roll 6 and one of rolls 7, 21, and 31, to roughen paper web 10 by pressing it against paper-production screen 13 by first press felt 11. First press felt 11 may also be utilized as a pick-up felt, particularly when the two rolls are arranged following a screen suction roll 15 located in the paper-production screen loop.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

Reference list

| | |
|---|---|
| 1 | press section |
| 2 | first main press device |

-continued

| Reference list | |
|---|---|
| 3 | first roll |
| 4 | second roll |
| 5 | pre-press device |
| 6 | first roll |
| 7 | second roll |
| 8 | first press nip |
| 9 | second press nip |
| 10 | web |
| 11 | felt belt |
| 12 | deflection roll |
| 13 | paper-production screen |
| 14 | deflection roll |
| 15 | screen suction roll |
| 16 | felt belt |
| 17 | deflection roll |
| 18 | conditioning device |
| 19 | suction contact roll |
| 20 | roll |
| 21 | second roll |
| 22 | felt cover |
| 23 | washing press |
| 24 | third press nip |
| 25 | first roll |
| 26 | second roll |
| 27 | second main press device |
| 28 | suction contact roll |
| 29 | felt belt |
| 30 | deflection roll |
| 31 | second roll |
| 32 | felt belt |
| 33 | deflection roll |
| 34 | suction device |
| 35 | first roll |
| 36 | second roll |
| 37 | felt belt |
| 38 | deflection roll |
| 39 | first roll |
| 40 | second roll |
| 41 | first roll |
| 42 | second roll |
| 43 | third main press device |
| 44 | fourth press nip |
| 45 | felt belt |
| 46 | deflection roll |
| 47 | felt belt |
| 48 | deflection roll |

What is claimed:

1. A forming section of a paper machine comprising:

a wire former comprising:

a screen belt loop having first and second sides, the first side of the screen belt loop contacting a first surface of the web, a pre-press device comprising two rolls forming a pre-press nip through which the screen belt loop and web are guided, and a first felt belt loop with at least one guide element guiding the first felt belt loop through the pre-press nip, the first felt belt loop being between the second side of the screen belt loop and one of the two rolls in the pre-press nip;

a press section comprising at least one press nip formed by press devices for draining and smoothing the web, the at least one press nip being arranged to smooth the first surface of the web more than a second surface of the web; and a second felt belt loop with at least one guide element guiding the second felt belt loop with the web through the pre-press nip and at least one of the at least one press nip, the second felt belt loop being positioned adjacent the second surface of the web.

2. The forming section of claim 1, the wire former being positioned before the press section with respect to a web travel direction, the wire former providing a greater degree of roughness to the first surface of the web than the second surface of the web.

3. The forming section of claim 1, the screen belt loop comprising a paper-production screen, the screen belt loop being positioned before the press section with respect to a web travel direction.

4. The forming section of claim 3, the wire former comprising a screen suction roll, the screen suction roll being located within the screen belt loop and before the pre-press nip with respect to a circulation direction of the screen belt loop.

5. The forming section of claim 1, further comprising at least one conditioning device to condition the first felt belt loop.

6. The forming section of claim 1, the two rolls comprising a suction roll.

7. The forming section of claim 1, the two rolls comprising a roll having a roll sleeve surface, the roll sleeve surface having recesses.

8. The forming section of claim 7, the recesses comprising grooves in the roll sleeve surface.

9. The forming section of claim 7, the recesses comprising blind holes in the roll sleeve surface.

10. The forming section of claim 1, the second felt belt loop contacting the first surface of the web.

11. The forming section of claim 1, the at least one nip comprising an extended nip shoe press.

12. The forming section of claim 1, one of the two rolls of the pre-press nip and at least one of the press devices of the at least one press nip being within the second felt belt loop.

13. The forming section of claim 1, further comprising an additional felt belt, the at least one press nip comprising a main press device, the additional felt belt being the only felt belt which is guided with the web through the main press device.

14. The forming section of claim 13, the main press device comprising a stiff roll.

15. The forming section of claim 1, the at least one press nip being formed by three main press devices.

16. The forming section of claim 15, further comprising an additional felt belt, at least one of the main press devices forming a main press nip, the additional felt belt being the only felt belt which is guided with the web through the main press nip.

17. The forming section of claim 15, at least one of the main press devices forming a second press nip where separate felt belts are positioned on each surface of the web, such that two felt belts and the web are guided through the second press nip.

18. The forming section of claim 15, at least one of the main press devices comprising a shoe press.

19. The forming section of claim 18, the shoe press comprising an extended nip press.

20. The forming section of claim 1, the device comprising a paper production machine and the web comprising a paper web.

21. A method for draining a web in a paper production machine comprising: a forming section comprising a wire former comprising: a screen belt loop having first and second sides, the first side of the screen belt loop contacting a first surface of the web, a pre-press device comprising two rolls forming a pre-press nip through which the screen belt loop and web are guided, and a first felt belt loop with at least one guide element guiding the first felt belt loop through the pre-press nip, the first felt belt loop being between the second side of the screen belt loop and one of the two rolls in the pre-press nip; a press section comprising at least one press nip formed by press devices for draining and smoothing the web, the at least one press nip being arranged to smooth the first surface of the web more than a second surface of the web; and a second felt belt loop with at least one guide element guiding the second felt belt loop with the web through the pre-press nip and at least one of the at least one press nip, the second felt belt loop being positioned adjacent the second surface of the web, the method comprising:

guiding the web through the wire former such that the first surface of the web is roughened more than the second surface of the web; and guiding the web through the press section of the paper production machine to drain the web and smooth the first surface of the web more than the second surface of the web.

22. The method of claim 21, the roughening of the web occurring before the smoothing of the first surface of the web more than the second surface of the web.

23. The method of claim 21, further comprising draining the web in the wire former.

24. The method of claim 21, further comprising conditioning the first felt belt loop.

25. The method of claim 21, further comprising suctioning at least one of the two rolls.

26. The method of claim 21, further comprising pressurizing the web in the wire former with a line pressure of between approximately 20 and 100 kN/m.

27. The method of claim 26, the pressurizing of the web being approximately 50 kN/m.

* * * * *